US011776468B2

(12) United States Patent
Schwarz

(10) Patent No.: US 11,776,468 B2
(45) Date of Patent: Oct. 3, 2023

(54) OPTOELECTRONIC LIGHT EMITTING DEVICE WITH A PROGRAMMING DEVICE AND METHOD FOR CONTROLLING AN OPTOELECTRONIC LIGHT EMITTING DEVICE

(71) Applicant: OSRAM Opto Semiconductors GmbH, Regensburg (DE)

(72) Inventor: Thomas Schwarz, Regensburg (DE)

(73) Assignee: OSRAM OPTO SEMICONDUCTORS GMBH, Regensburg (DE)

( * ) Notice: Subject to any disclaimer, the term of this patent is extended or adjusted under 35 U.S.C. 154(b) by 21 days.

(21) Appl. No.: 17/614,061

(22) PCT Filed: May 19, 2020

(86) PCT No.: PCT/EP2020/063931
§ 371 (c)(1),
(2) Date: Nov. 24, 2021

(87) PCT Pub. No.: WO2020/239530
PCT Pub. Date: Dec. 3, 2020

(65) Prior Publication Data

US 2022/0230583 A1 Jul. 21, 2022

(30) Foreign Application Priority Data

May 24, 2019 (DE) ..... 10 2019 113 916.3

(51) Int. Cl.
*G09G 3/3208* (2016.01)

(52) U.S. Cl.
CPC ... *G09G 3/3208* (2013.01); *G09G 2310/0213* (2013.01); *G09G 2320/064* (2013.01)

(58) Field of Classification Search
CPC ..... G09G 3/3208; G09G 2310/0213; G09G 2320/064
See application file for complete search history.

(56) References Cited

U.S. PATENT DOCUMENTS

2008/0055206 A1* 3/2008 Ryu ..... G09G 3/3258 345/76
2008/0191977 A1* 8/2008 Park ..... G09G 3/2022 345/82

(Continued)

FOREIGN PATENT DOCUMENTS

| | | |
|---|---|---|
| DE | 697 15 837 T2 | 1/2003 |
| DE | 10 2008 004 963 A1 | 8/2008 |
| EP | 1 895 490 A2 | 3/2008 |

OTHER PUBLICATIONS

International Search Report issued for corresponding International Patent Application No. PCT/EP2020/063931 dated Jul. 2, 2020, along with an English translation.

(Continued)

*Primary Examiner* — Amare Mengistu
*Assistant Examiner* — Jennifer L Zubajlo
(74) *Attorney, Agent, or Firm* — Hauptman Ham, LLP

(57) ABSTRACT

An optoelectronic light emitting device includes a plurality of programmable pixels arranged in a matrix of rows and columns, each pixel including at least one optoelectronic semiconductor component, and programming device configured to program the pixels in a plurality of successive time intervals. A row pattern including a subset of the rows of the matrix is given. The programming device is configured to program the pixels of those rows per time interval which are comprised by the row pattern. The row pattern is shifted by at least one row per time interval.

17 Claims, 8 Drawing Sheets

Figure 1A:
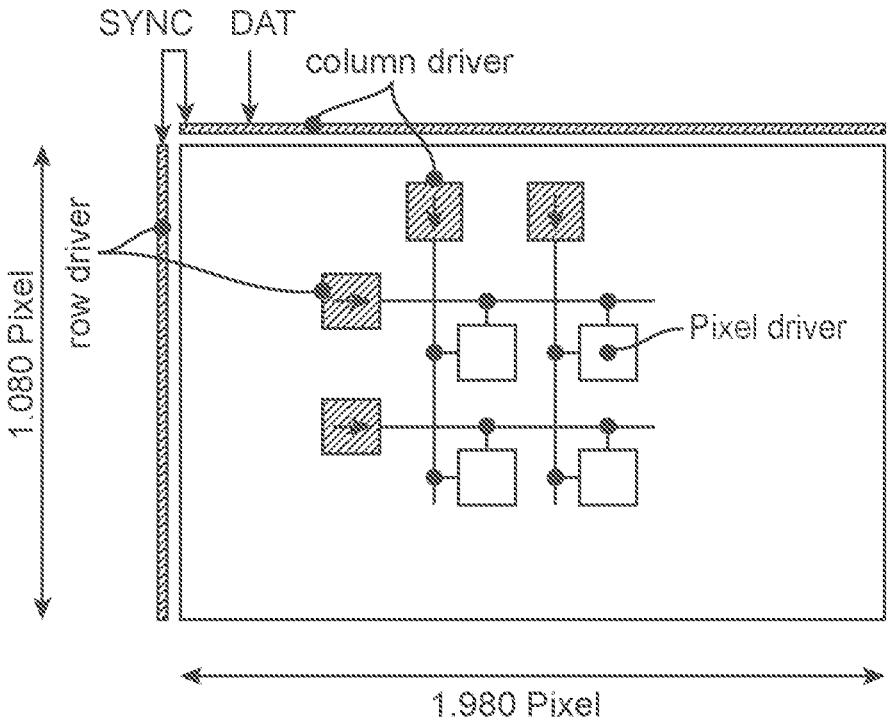
FIG. 1A (RELATED ART)

| bit | PWM-time-intervals | Programming time intervals | Total time intervals | Programming rows per time inverval | clock frequency/ MHz | LED-off-percentage |
|---|---|---|---|---|---|---|
| 8 | 255 | 16 | 271 | 38 | 0,37 | 5,9% |
| 10 | 1,023 | 22 | 1,043 | 19 | 0,58 | 1,9% |
| 11 | 2,047 | 22 | 2,069 | 11 | 0,68 | 1,1% |
| 14 | 16,383 | 28 | 16,411 | 11 | 5,4 | 0,2% |
| 16 | 65,535 | 32 | 65,567 | 11 | 21,6 | 0,05% |
| 18 | 262,143 | 36 | 262,179 | 11 | 86,5 | 0,01% |
| 20 | 1,048,575 | 40 | 1,048,615 | 11 | 346 | 0,004% |
| 22 | 4,194,303 | 44 | 4,194,347 | 11 | 1384 | 0,001% |

Table 4

(56) References Cited

U.S. PATENT DOCUMENTS

| | | | | |
|---|---|---|---|---|
| 2015/0364080 | A1* | 12/2015 | Lee | G09G 3/3208 345/211 |
| 2019/0051250 | A1* | 2/2019 | Lee | G09G 3/3233 |
| 2021/0407382 | A1* | 12/2021 | Momose | G09G 3/3233 |
| 2021/0407413 | A1* | 12/2021 | Momose | G09G 3/3233 |

OTHER PUBLICATIONS

Written Opinion issued for corresponding International Patent Application No. PCT/EP2020/063931 dated Jul. 2, 2020.

* cited by examiner

| bit | PWM-time-intervals | execution time per bit in µs | programming time per bit and row in µs | programming frequency in MHz | LED-off-percentage |
|---|---|---|---|---|---|
| 8 | 255 | 65 | 0,06 | 17 | 0,1% |
| 10 | 1.023 | 16 | 0,02 | 66 | 0,1% |
| 12 | 4.095 | 4 | 0,00 | 265 | 0,1% |
| 14 | 16.383 | 1 | 0,00 | 1.062 | 0,1% |
| 16 | 65.535 | 0 | 0,00 | 4.247 | 0,1% |

Table 1

| bit | PWM-time-intervals | execution-time per bit in µs | programming-time per bit and row in µs | programming-frequency in MHz | LED-off-percentage |
|---|---|---|---|---|---|
| 7 | 127 | 131 | 1,22 | 0,8 | 0,9% |
| 8 | 255 | 65 | 0,61 | 1,7 | 0,9% |
| 12 | 4.095 | 4 | 0,04 | 27 | 0,9% |
| 14 | 16.383 | 1 | 0,01 | 106 | 0,9% |
| 16 | 65.535 | 0 | 0,00 | 425 | 0,9% |

Table 2

| bit | PWM-time-intervals | Programming time intervals | Total time intervals | Programming rows per time interval | clock frequency/ MHz | LED-off percentage |
|---|---|---|---|---|---|---|
| 8 | 255 | 8 | 263 | 38 | 0,60 | 3,0% |
| 10 | 1.023 | 10 | 1.033 | 16 | 1,0 | 1,0% |
| 12 | 4.095 | 12 | 4.107 | 11 | 2,7 | 0,3% |
| 14 | 16.383 | 14 | 16.397 | 11 | 10,8 | 0,1% |
| 16 | 65.535 | 16 | 65.551 | 11 | 43,3 | 0,02% |
| 18 | 262.143 | 18 | 262.161 | 11 | 173 | 0,01% |
| 20 | 1.048.575 | 20 | 1.048.595 | 11 | 692 | 0,002% |
| 22 | 4.194.303 | 22 | 4.194.325 | 11 | 2768 | 0,001% |

Table 3

| bit | PWM-time-intervals | Programming time intervals | Total time intervals | Programming rows per time invervall | clock frequency/ MHz | LED-off-percentage |
|---|---|---|---|---|---|---|
| 8 | 255 | 16 | 271 | 38 | 0,31 | 5,9% |
| 10 | 1.023 | 20 | 1.043 | 16 | 0,50 | 1,9% |
| 11 | 2.047 | 22 | 2.069 | 11 | 0,68 | 1,1% |
| 14 | 16.383 | 28 | 16.411 | 11 | 5,4 | 0,2% |
| 16 | 65.535 | 32 | 65.567 | 11 | 21,6 | 0,05% |
| 18 | 262.143 | 36 | 262.179 | 11 | 86,5 | 0,01% |
| 20 | 1.048.575 | 40 | 1.048.615 | 11 | 346 | 0,004% |
| 22 | 4.194.303 | 44 | 4.194.347 | 11 | 1384 | 0,001% |

Table 4

OPTOELECTRONIC LIGHT EMITTING DEVICE WITH A PROGRAMMING DEVICE AND METHOD FOR CONTROLLING AN OPTOELECTRONIC LIGHT EMITTING DEVICE

CROSS REFERENCE TO RELATED APPLICATION

This application is a National Stage of International Application No. PCT/EP2020/063931, filed on May 19, 2020, which designates the United States and was published in Europe, and which claims priority to German Patent Application No. 10 2019 113 916.3, filed on May 24, 2019, in the German Patent Office. Both of the aforementioned applications are hereby incorporated by reference in their entireties.

The present invention relates to an optoelectronic light emitting device with a programming device and a method for controlling an optoelectronic light emitting device.

For the operation of optoelectronic light emitting devices, especially LED or μLED display devices, also called LED or μLED displays, pulse width modulation (PWM) is often used together with passive matrix switching. In a matrix of rows and columns, only one row is operated at a time. Each row is assigned a time interval of the same size within the refresh rate. The alternation of the rows is called multiplexing. With a multiplexing of 1:32, the brightness must be 32 times higher than the desired average brightness of the picture. The drivers are manufactured in monocrystalline silicon and therefore have no frequency limitation up to 50 or 100 MHz (passive matrix).

Thin-film transistor (TFT) technology can also be used as a low-cost display driver solution. However, the upper operating frequency of thin-film transistors is approx. 1 MHz. For programming LED or μLED displays, i.e. for writing the image data into the display, correspondingly low programming frequencies should therefore be used (active matrix).

One of the objects of the present invention is to provide an optoelectronic light emitting device capable of containing thin film transistors and configured to be operated at programming frequencies suitable for the operation of thin film transistors. It is also intended to provide a method for controlling an optoelectronic light emitting device.

One object of the invention is solved by an optoelectronic light emitting device having the features of claim 1. A further object of the invention is solved by a method having the features of claim 9. Preferred embodiments and further developments of the invention are indicated in the dependent claims.

An optoelectronic light emitting device according to a first aspect of the present application comprises a plurality of programmable pixels arranged in a matrix of rows and columns. Each of the pixels comprises at least one optoelectronic semiconductor component. The optoelectronic light emitting device may be a display.

Furthermore, the optoelectronic light emitting device comprises a programming device for programming the pixels. The programming device programs the pixels in several successive time intervals.

For programming the pixels, a row pattern is specified that comprises a subset of the rows of the matrix and can also be referred to as a programming pattern or programming mask. Per time interval, the programming device programs the pixels of those rows that are comprised by the row pattern or are specified by the row pattern. Furthermore, the row pattern is shifted, in particular by the programming device, by at least one row per time interval, so that the programming device programs the pixels of at least partially different rows in each time interval.

The pixel matrix programmed by the programming device does not have to comprise all pixels of the optoelectronic light emitting device. It may also be provided that the pixel matrix programmed by the programming device represents only one segment of the complete pixel matrix of the optoelectronic light emitting device. Further segments may be programmed by one or more programming devices having the same features as the programming device described here.

The given row pattern always includes several rows, but fewer rows than the matrix has, i.e. the subset is a true subset of the set of rows of the matrix.

In one example, the matrix contains 15 rows of pixels, with the rows numbered from 1 to 15. The row pattern comprises four rows, namely row nos. 1, 2, 4 and 8. In general, the row pattern does not have to consist of continuous rows, but can also have one or more gaps, each comprising one or more row(s). In the present example, there are gaps in the row pattern between rows 2 and 4 and rows 4 and 8.

In an application of the row pattern, the pixels of those rows of the matrix that are comprised by the row pattern are programmed in a first time interval. If the row pattern is aligned in the first time interval in the example described so that it starts in row 1 of the matrix, then rows 1, 2, 4 and 8 are comprised by the row pattern in the first time interval and the pixels of these rows are programmed.

Pixels of those rows that are not comprised by row patterns in a time interval are not programmed in this time interval. In the given example, the pixels of rows 3, 5 to 7 and 9 to 15 are therefore not programmed in the first time interval.

The programming of the pixels during a time interval is carried out in particular by means of a multiplex procedure, i.e. the pixels are programmed row by row. In the above example, first the pixels of row 1, then the pixels of row 2, then the pixels of row 4 and then the pixels of row 8 are programmed in the first time interval.

Each of the pixels may comprise a plurality of subpixels. For example, each pixel may contain three subpixels for the colours red, green and blue, each subpixel having a corresponding optoelectronic semiconductor component.

When programming a row during a time interval, in particular all subpixels of the pixels concerned are rewritten.

In the second time interval following the first time interval, the row pattern is shifted by at least one row in the matrix. According to one embodiment, the row pattern is shifted by exactly one row per time interval. In the above example, if the row pattern is shifted down by exactly one row, then in the second time interval, rows 2, 3, 5 and 9 are comprised by the row pattern and the pixels of these rows are programmed, while the pixels of all remaining rows are not programmed in the second time interval.

The described procedure is continued accordingly.

As soon as the row pattern has reached the end of the matrix in a certain time interval, that part of the row pattern that goes beyond the end of the matrix starts again at the beginning of the matrix. In the above example, rows 9, 10 and 12 as well as row 1 of the matrix are therefore comprised in the row pattern in the ninth time interval.

In particular, the time intervals are of equal length. The length or duration of a time interval can depend on the length or duration of the refresh cycle. The refresh cycle can be as long as the refresh time (=1/frame rate). During a refresh cycle, all rows of the matrix must be rewritten with information. Furthermore, the duration of the time interval depends on the number n of bits of image information to be represented in a pixel or subpixel. In particular, a refresh cycle is divided into $2^n-1$ time intervals. The length of a time interval is therefore given by the quotient of the length of the refresh cycle and the term $2^n-1$. For a refresh cycle of 16.7 ms and 4-bit information, i.e. n=4, the length of a time interval is 16.7 ms/15.

The row pattern repeats after $2^n-1$ rows.

Each pixel or subpixel may have a memory in which 1 bit can be stored. For example, the memory can be a capacitor that can be charged appropriately so that its output voltage can indicate two states. The capacitor may be embedded in a so-called 2T1C circuit, which comprises two transistors in addition to the capacitor. Furthermore, a multi-transistor equivalent or a 1-bit flip-flop per pixel or subpixel can be used to store 1 bit.

Pulse width modulation, in particular binary pulse width modulation, can be used both for programming operation, which is understood to mean programming or writing the image information data in each pixel or subpixel, and for execution operation, in which the stored image information data is displayed. In binary pulse width modulation, each bit is programmed individually. For example, the most significant bit (MSB) is programmed first, followed by the other bits up to the least significant bit (LSB).

The electromagnetic radiation emitted by the optoelectronic semiconductor components can be, for example, light in the visible range, ultraviolet (UV) light and/or infrared light.

The optoelectronic semiconductor components can be designed, for example, as light-emitting diodes (LED), organic light-emitting diodes (OLED), light-emitting transistors or organic light-emitting transistors. In various embodiments, the optoelectronic semiconductor components can be part of an integrated circuit.

In particular, when LEDs are used, they can be designed as μLEDs, i.e. micro-LEDs. A μLED has only a very thin substrate or no substrate at all, which makes it possible to manufacture the μLED with small lateral expansions, especially in the μm range.

When using LEDs and/or μLEDs as optoelectronic semiconductor components, operation by means of pulse width modulation is advantageous in order to achieve sufficient image quality. The reason for this is the strongly varying wavelengths of an LED at different operating currents.

The described optoelectronic light emitting device according to the first aspect can be an active matrix LED display with storage of 1 bit per pixel or subpixel and enables the use of low-cost TFT technology as well as simple, proven and reliable 2T1C circuits. Furthermore, large programming fields can be programmed at small programming frequencies, low off times can be achieved in which the optoelectronic semiconductor components are switched off during programming, and the flickering as well as the image quality during filming of the display can be improved by artificially increasing the "frame rate".

As described above, the row pattern can be shifted by exactly one row per time interval according to one embodiment. The row pattern can be shifted downwards by one row in the matrix at a time, but it can also be provided that the row pattern is shifted upwards by one row in the matrix.

In an alternative embodiment, the row pattern is shifted down or up by more than one row per time interval.

The programming device can be configured in such a way that in successive time intervals, in particular during a refresh cycle, it programs in a row the bits of the image information to be reproduced by the optoelectronic components according to a predetermined bit pattern. The bit pattern may be the same for all rows.

For example, in the bit pattern, the bits can be ordered according to their significance. For example, per pixel or subpixel, the most significant bit can be programmed first, followed by the least significant bits in descending order up to the least significant bit. This order can also be reversed.

In one example, for a 4-bit image information, the most significant bit 3 (MSB) will be programmed in a first time interval, during the 9th and 13th time intervals the next least significant bits 2 and 1 respectively will be programmed, until finally in the 15th time interval the least significant bit 0 (LSB) will be programmed.

According to a further embodiment, the bits in the bit pattern are not ordered according to their significance. For example, another bit can be inserted between two bits that directly follow each other in their significance. The following bit patterns are examples of such bit patterns: Bit 3, Bit 0, Bit 2, Bit 1; Bit 3, Bit 1, Bit 2, Bit 0; Bit 1, Bit 3, Bit 2, Bit 0.

Furthermore, at least part of at least one bit may be inserted into another bit in the bit pattern. For example, a less significant bit can be inserted into a higher significant bit, or two or more less significant bits can be inserted into a higher significant bit, or at least parts of one or more less significant bits can be inserted into a higher significant bit. Shifting at least parts of less significant bits into higher significant bits increases the likelihood that additional flanks will occur in the representation of the image information, thereby reducing unintended flickering of the image representation.

A pixel driver circuit can be assigned to each pixel or each subpixel. In particular, the pixel driver circuit can have a 1-bit memory into which a bit can be written by the programming device. The pixel driver circuit uses the programming to drive the associated semiconductor component so that it either lights up or does not light up according to the programming.

A method according to a second aspect of the present application is suitable or intended for controlling, in particular programming, an optoelectronic light emitting device. The optoelectronic light emitting device comprises a plurality of programmable pixels arranged in a matrix of rows and columns. Each pixel comprises at least one optoelectronic semiconductor component. The pixels are programmed in a plurality of successive time intervals. A row pattern comprising a subset of the rows of the matrix is given for programming the pixels. For each time interval, the pixels of those rows are programmed that are comprised by the row pattern or are specified by the row pattern. The row pattern is shifted by at least one row per time interval.

The method for controlling the optoelectronic light emitting device according to the second aspect may comprise the embodiments of the optoelectronic light emitting device according to the first aspect described above.

Figure 1B:
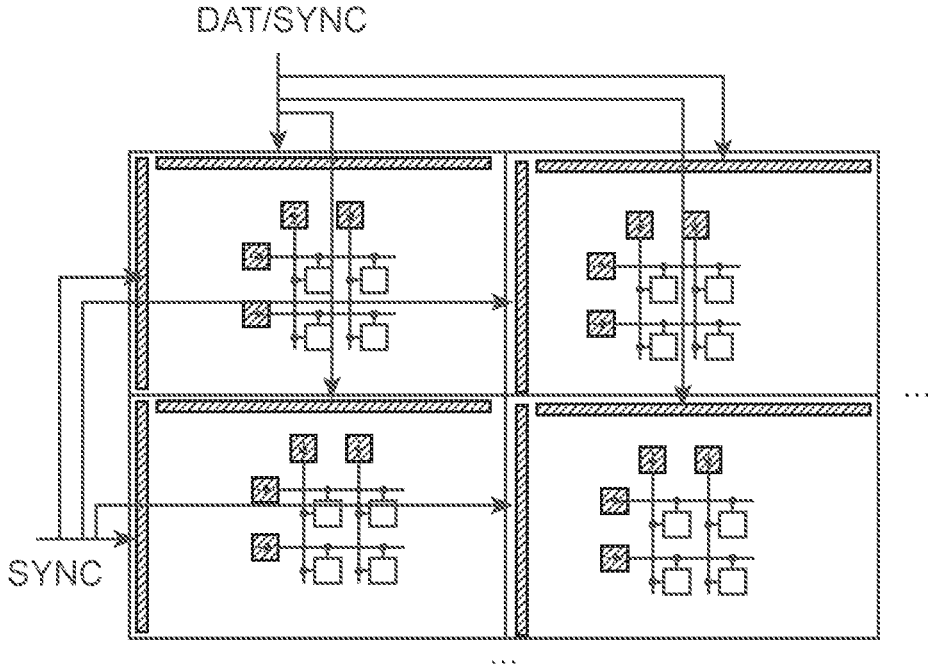
Figure 2:
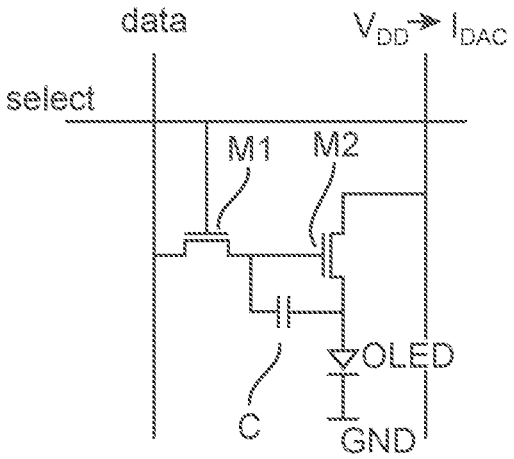
Figure 3A:
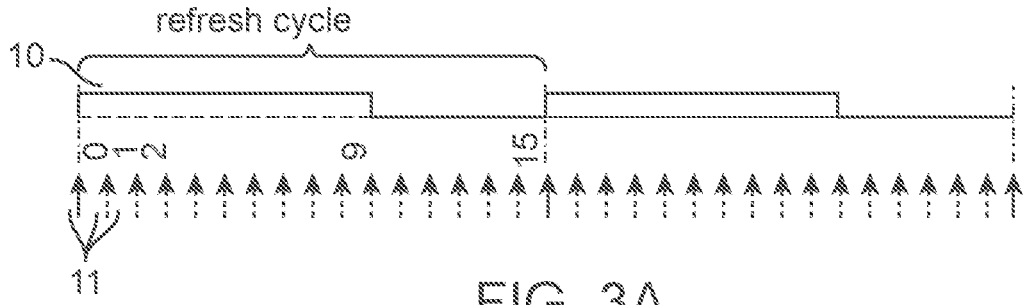
FIG. 3A (RELATED ART)
Figure 3B:
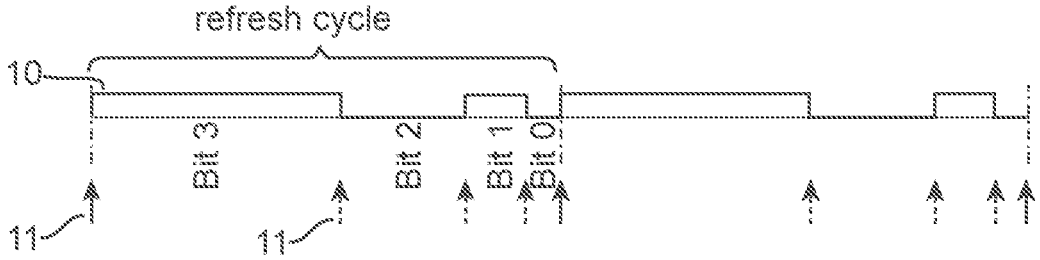
Figure 4:
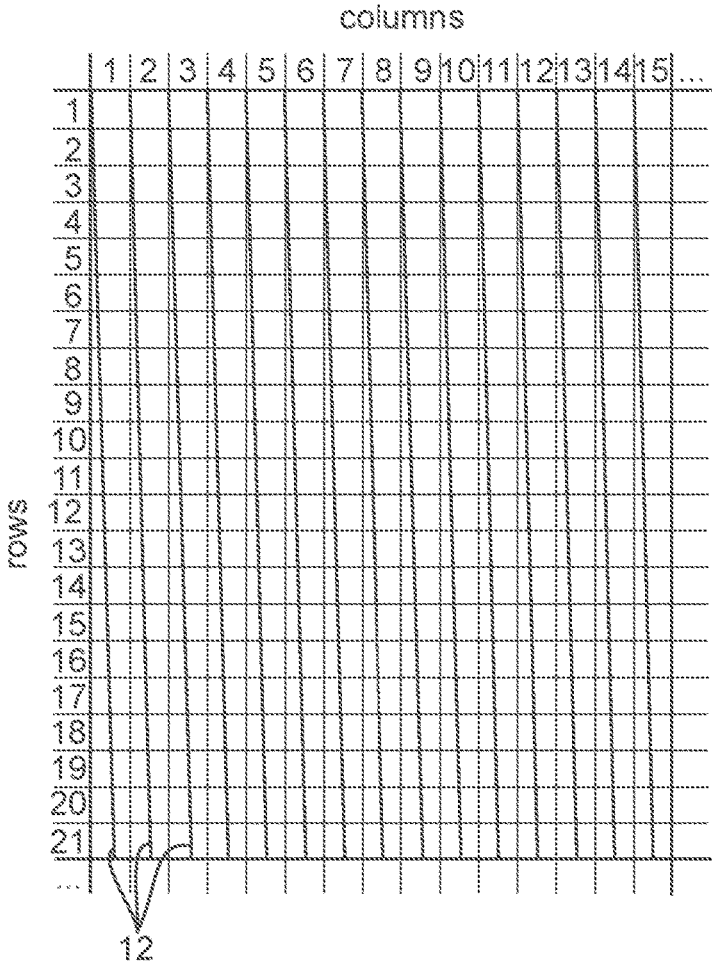
Figure 5:
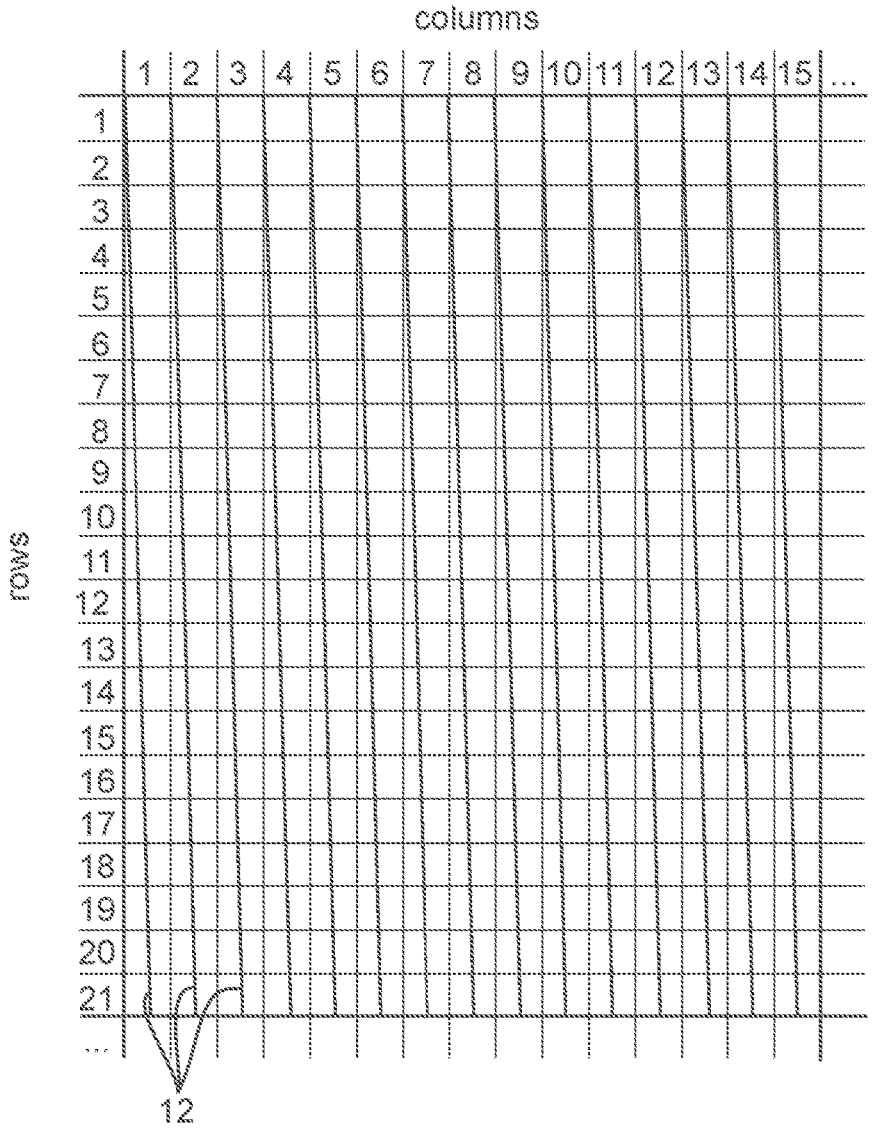
Figure 6:
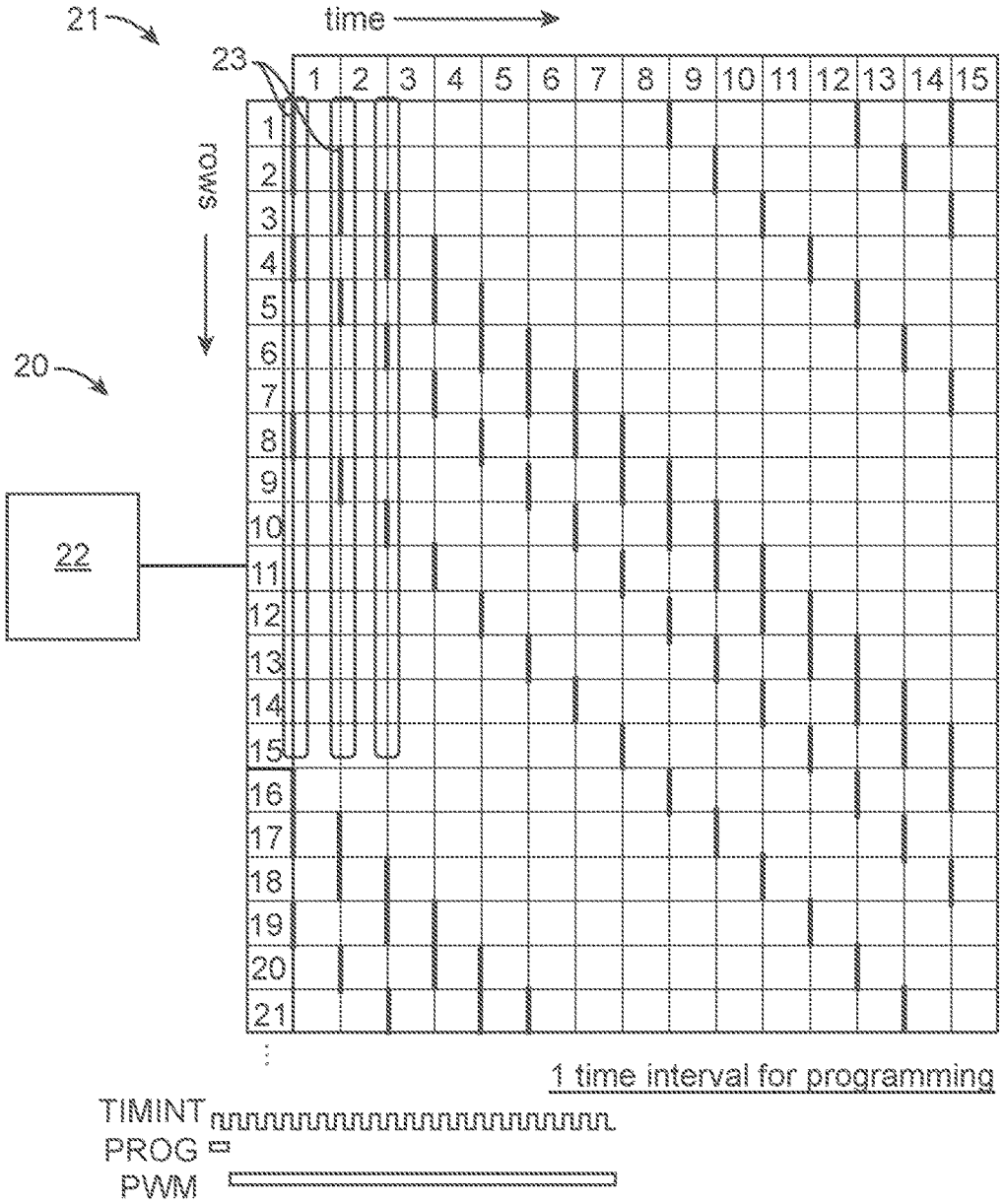
Figure 7:
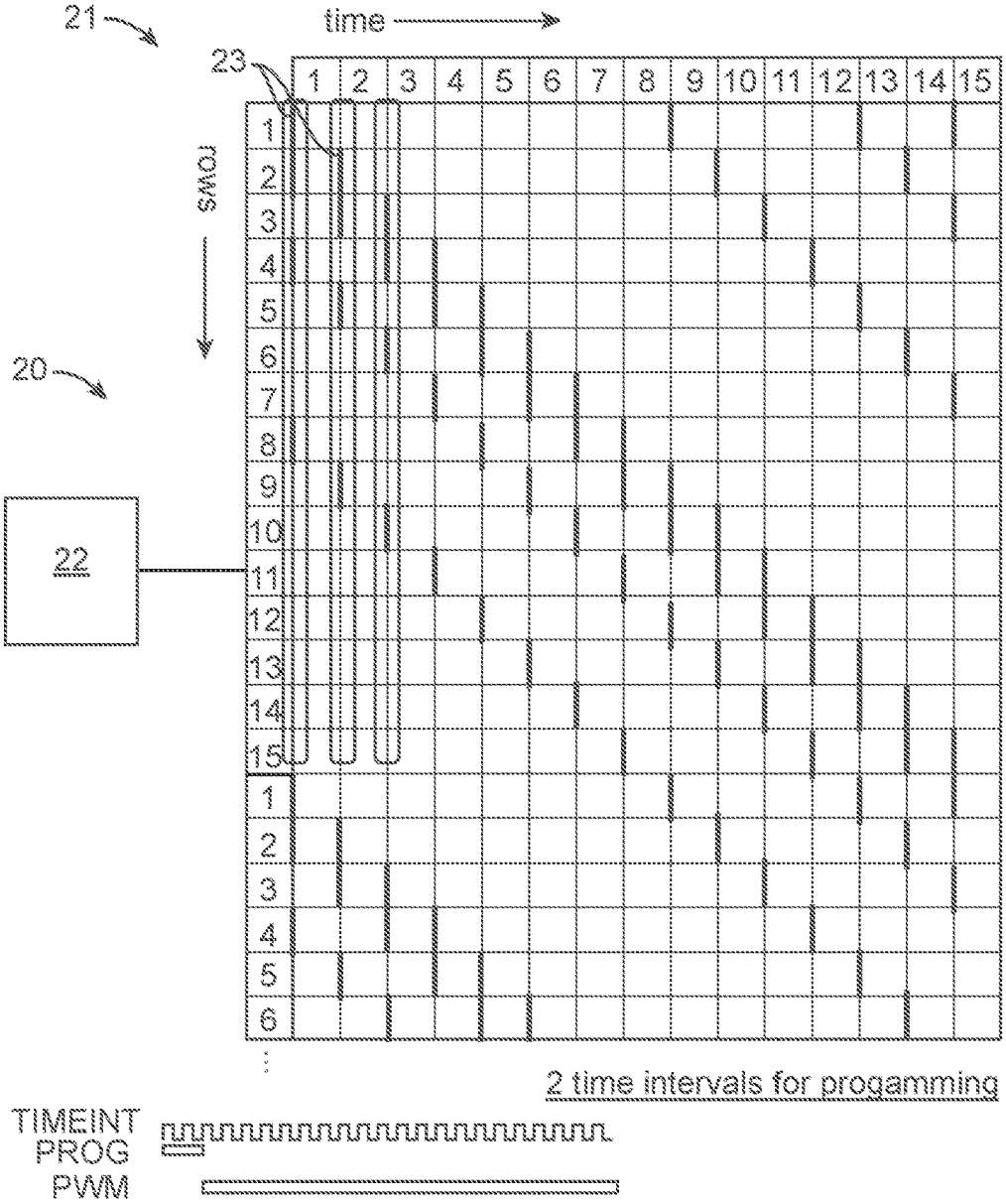
Figure 8:
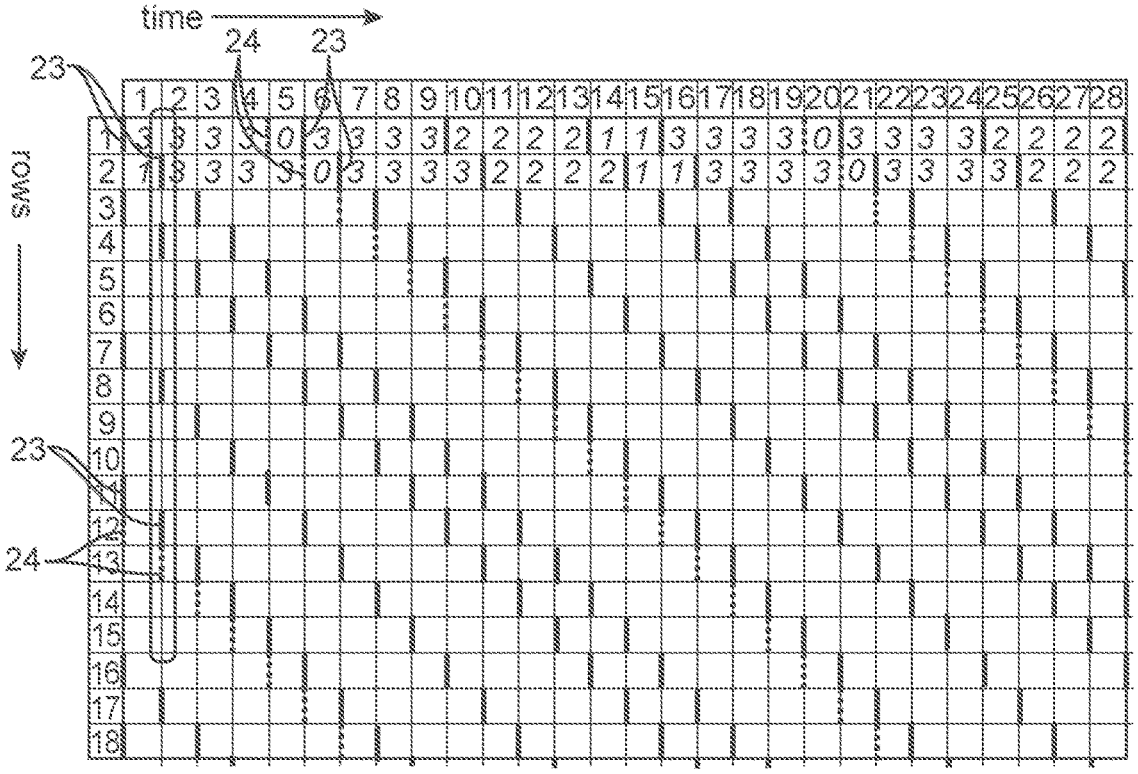
Figure 9:
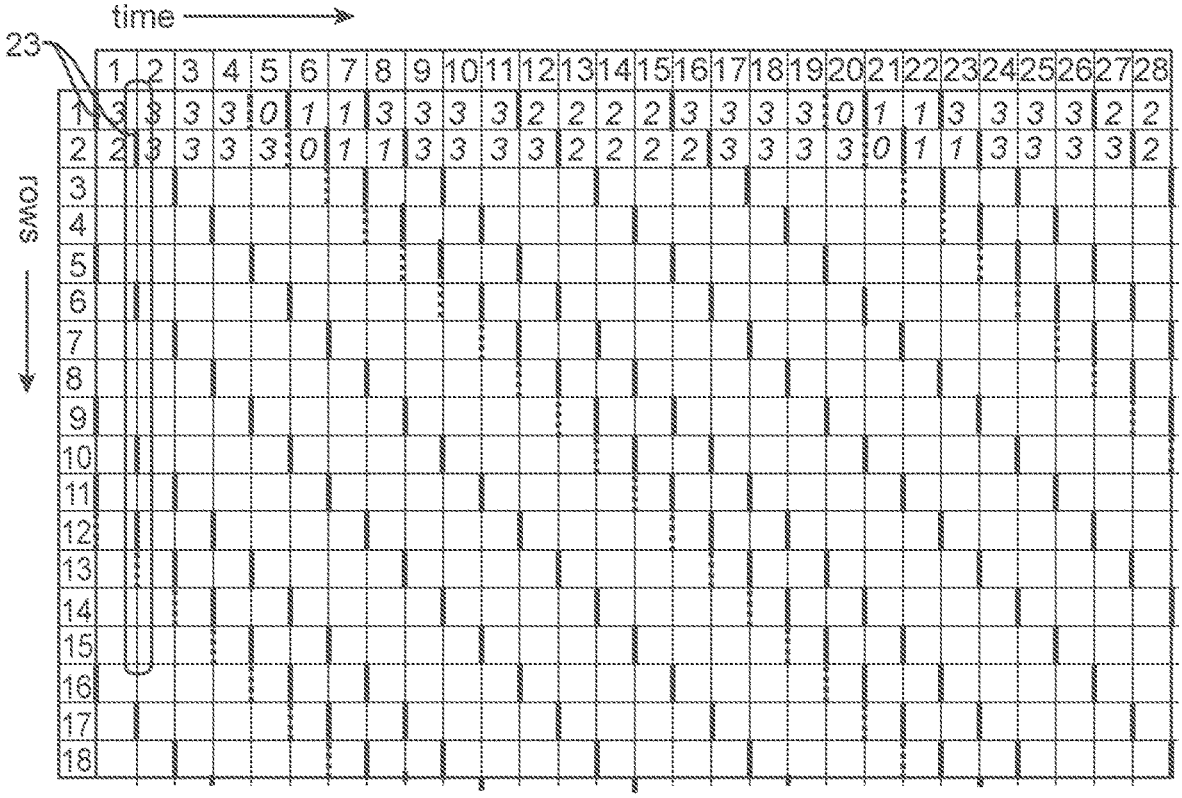
Figure 10:
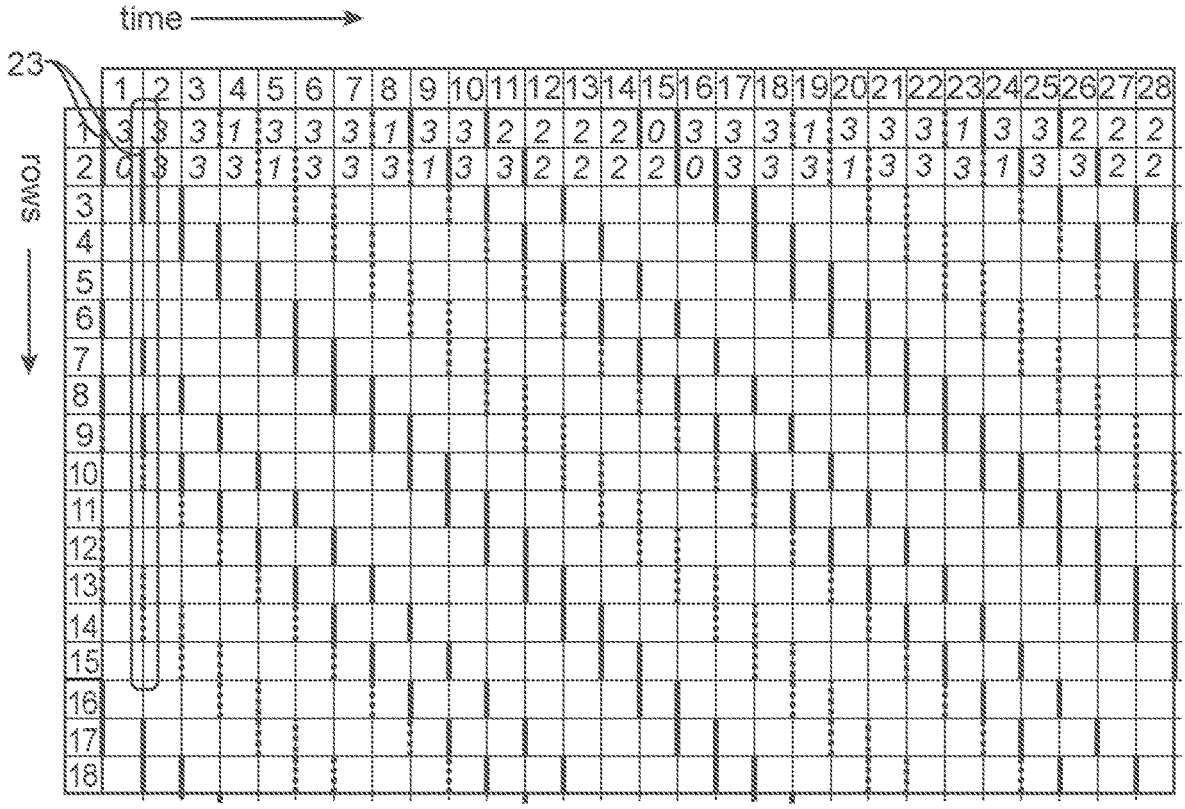

In the following, embodiments of the invention are explained in more detail with reference to the accompanying drawings. These show schematically:

FIGS. 1A and 1B different structures for programming the pixels of LED displays;

FIG. 2 a pixel driver with an active matrix structure for an OLED;

FIG. 3A an illustration of a conventional pulse width modulation;

FIG. 3B an illustration of a binary pulse width modulation;

FIGS. 4 and 5 illustrations of a display and the programming of the pixels of the display;

FIGS. 6 and 7 illustrations of embodiments of an optoelectronic light emitting device and the programming of pixels; and FIGS. 8 to 10 illustrations of further variants of pixel programming.

In the following detailed description, reference is made to the accompanying drawings, which form part of this description and in which specific embodiments in which the invention may be practised are shown for illustrative purposes. As components of embodiments may be positioned in a number of different orientations, the directional terminology is for illustrative purposes and is not limiting in any way. It is understood that other embodiments may be used and structural or logical changes may be made without departing from the scope of protection. It is understood that the features of the various embodiments described herein may be combined with each other, unless specifically stated otherwise. The following detailed description is therefore not to be understood in a restrictive sense. In the figures, identical or similar elements are given identical reference signs where appropriate.

FIGS. 1A and 1B show different structures for programming the pixels and subpixels of LED displays. In LED display electronics, a distinction is made between programming operation and execution operation. Programming operation means programming or writing the image information data into each individual subpixel. If the image data is available in the subpixel, it is stored there and executed during the execution operation, i.e. shown by the display. In the simplest case, the execution consists of transferring the programmed information 0 or 1 to the state "LED switched on" or the state "LED switched off". In other cases, a voltage is programmed. Low voltages lead to low brightness and high voltages to high brightness of the respective LED. If there are more electronics in the pixel, pulse width modulation can also be carried out at pixel level.

In programming, a distinction is made between daisy-chain and cross-matrix programming. Cross-matrix programming is common in TFT circuits. In a conventional programming structure, as exemplarily shown in FIG. 1A, the subpixels are interconnected via a cross matrix. The row lines are connected to the row driver and the column lines are connected to the column driver. Usually, in a TFT display, the drivers are located only at the edge of the display.

In a segmented programming structure, exemplarily shown in FIG. 1B, the display is divided into different segments. Each segment comprises a row driver and a column driver. The driver effort and the interconnection are thus significantly more elaborate and complicated. Also, the space for the drivers on the front is usually not available. The advantage of the segmented programming structure is that the programming frequencies can be significantly reduced compared to the conventional programming structure, especially linearly with the number of segments up or down.

FIG. 2 schematically shows a pixel driver with an active matrix structure for an OLED. Information is stored in a capacitor C by charging or not charging the capacitor C to a certain voltage. The capacitor C is programmed via a transistor M1. The OLED is supplied with a constant current via a transistor M2, provided that the capacitor C has a corresponding voltage.

In programming mode, the column driver provides the programming voltage for all columns individually via a data line. The row driver switches through the rows step by step for programming via a line select. Programming can be done with a constant voltage, with a constant current or with feedback.

Generally, a distinction is made between subpixels with memories that can store 1 bit of information and subpixels with memories that can store all bits. If all bits can be stored in the subpixel, they must also be executed there. This not only leads to a high storage effort in the pixel, but also an effort (counter, comparator, current source) for the PWM in each pixel, which makes the circuit expensive and complex.

The subpixels described below are configured in such a way that they can only store exactly 1 bit. However, the 1-bit information can also be analogue and stored as a voltage in a capacitor. By using different voltages, current modulation can take place in addition to PWM, e.g. for dimming. Colour shifts due to wavelength shifts are then avoided by electronic colour correction. This is only possible in dimming mode and not for the constantly changing picture content.

In pulse width modulation, a distinction is made between conventional pulse width modulation and binary pulse width modulation. Examples of conventional and binary pulse width modulation are shown in FIGS. 3A and 3B respectively.

The duration of a refresh cycle in the examples shown in FIGS. 3A and 3B is 16.7 ms and the refresh rate is 60 Hz. The curves 10 indicate the execution operation and the arrows 11 indicate the programming times.

In the selected examples, 4 bits of image information are stored in the subpixel during a refresh cycle. The solid arrows 11 show the programming times for the case that all 4 bits can be stored and executed in the subpixel. If the dashed arrows 11 are added, the programming times are given for the case that only 1 bit can be stored in the subpixel.

In the examples, the binary code 1010 is to be shown, whereby, according to the LSB 0 coding, the most significant bit 3 (MSB) is given first and the least significant bit 0 (LSB) last. The binary code 1010 corresponds to the decimal number 10 (=8+2).

With the conventional pulse width modulation shown in FIG. 3A, only one rising and one falling flank is present at the LED within a refresh cycle.

In the binary pulse width modulation shown in FIG. 3B, for example, the most significant bit (MSB, bit 3) is executed first, then the next bit (bit 2) with half the time and again the next bit (bit 1) with half the time. At the end of the refresh cycle, the least significant bit (LSB, bit 0) is executed with only one time interval. In this example, the least significant bit gets one time interval and the most significant bit gets 8 time intervals.

If the subpixel contains 4-bit memory, programming is only required at the beginning of the refresh cycle. If, on the other hand, only 1-bit memories are present, there is a big difference between conventional and binary pulse width modulation. For conventional pulse width modulation, $2^n$ programming operations are necessary, i.e., 16 programming operations in the present example, where n indicates the number of bits. For binary pulse width modulation, only n programming operations are necessary, i.e., 4 programming operations in the present example. The saving in this example is therefore a factor of 4. For 8 bits the saving is $2^8/8=32$ and for 10 bits $2^{10}/10=102.4$.

FIG. 4 schematically shows a display with a pixel matrix of rows and columns. As an example, 1,080 rows are provided as well as a refresh rate of 60 Hz and a refresh cycle with a length of 16.667 ms. The pixels or subpixels are programmed using conventional PWM programming. The lines 12 in FIG. 4 indicate the time slot in which the respective row is programmed. Furthermore, table 1 shows the resulting PWM time intervals for different numbers of bits, the execution time per bit in μs, the programming time per bit and row in μs, the programming frequency in MHz as well as the percentage LED-off for the case that the LED cannot light up during programming. The PWM time intervals are calculated from the term $2^n-1$, where n indicates the number of bits. The execution time per bit is given by the quotient of the refresh cycle duration and the number of PWM time intervals, and the programming time per bit and row is given by the quotient of the execution time and the number of display rows. The LED-off percentage can be calculated from the quotient of programming time and execution time.

With conventional PWM programming, all rows must be rewritten with information within a refresh cycle. With 1,080 rows, only 1/1,080*16.667 ms remains for programming a row. In addition, with 8 bits, programming must be done $2^8=256$ times per row. Assuming that the LED does not light up during programming, this results in a programming frequency of 17 MHz and an LED-off percentage of 0.1%. Since the programming frequency of 17 MHz is significantly higher than the upper operating frequency of thin-film transistors of 1 MHz, this proposal does not allow the use of TFT technology.

The display shown in FIG. 5 differs from the display shown in FIG. 4 by the number of rows, which in FIG. 5 have been reduced by a factor of 10 to 108 rows. This also reduces the programming frequencies by a factor of 10. As can be seen from Table 2, a programming frequency of less than 1 MHz results for 7 bits. However, the display must be segmented by a factor of 10, which results in 10 times more driver effort for the column drivers. In addition, a high-quality image cannot be generated with 7 bits.

FIG. 6 shows an optoelectronic light emitting device 20 as an embodiment of an optoelectronic light emitting device according to the first aspect of the application. The operation of the optoelectronic light emitting device 20 described below is an example of a method for controlling an optoelectronic light emitting device according to the second aspect of the application.

The optoelectronic light emitting device 20 comprises a display 21 with a plurality of programmable pixels arranged in a matrix of rows and columns. Each pixel comprises one or more LEDs. Further, the optoelectronic light emitting device 20 comprises a programming device 22 for programming the pixels of the display 21.

In FIG. 6, the rows are plotted against successive time intervals to illustrate the operation of the display 21. In the present example, the display 21 contains a total of 1,080 rows. The rows 23 in the illustration of FIG. 6 represent the programming times of the respective row. After that, execution takes place in the remaining part of the respective time interval.

To make the example clear, it is designed for 4 bits. In practice, at least 8 bits are needed for sufficient picture quality. In the first time interval, not all rows are programmed, but only the rows that are given by a row or programming pattern. In the example, the row pattern contains rows 1, 2, 4 and 8 and is repeated after $2^n-1$ rows, i.e. after 15 rows in this case. Consequently, the row pattern comprises the rows 1, 2, 4, 8, 16, 17, 19, . . . . At time intervals 2 and 3 and all further time intervals the row pattern is shifted down one row at a time. This can be called staggering.

The number of rows to be programmed is thus constant and small at each time interval. If the number of rows to be programmed is not equal to $N\times2^n-1$, where N is the number of blocks into which the rows are divided, the remaining rows must be treated separately. To do this, a whole block can be added and the remaining time in which there are no more rows to be programmed can be paused or immediately after the last row, it is possible to jump up to the first row.

Table 3 shows the resulting PWM time intervals, the programming time intervals, the total time intervals from PWM time intervals and programming time intervals, the programming rows per time interval, the clock frequency in MHz and the LED-off percentage for various bit numbers.

For 8 bits, there are 255 PWM time intervals and 8 programming time intervals. Together this makes 263 time intervals. Furthermore, there are 38 programming rows per time interval. This is calculated from 1,024 rows with N=4 blocks and 8 programming rows per block, i.e., 4×8=32. The remaining 6 rows are calculated from $2^6-64$ with 1,024+64=1,088>1,080. The case is calculated where the jump back to row 1 is made as soon as possible.

From 12 bits, programming is done in one block, since $2^{12}$ is greater than 1,080. As can be seen in Table 3, advantageous solutions are available for 8 and 10 bit and 1,080 rows at 60 Hz refresh rate. The LED-off times are low.

FIG. 7 and Table 4 show a variant of FIG. 6, whereby twice as much time is provided for programming the subpixels. This reduces the programming frequencies.

However, the LED-off percentage increases. Good solutions are thus possible up to 11 bits.

Further variants of the embodiment from FIG. 6 are shown in FIGS. 8 to 10.

Since the refresh rate is quite low at 60 Hz, the human eye can perceive this low frequency negatively as flickering in the case of pulse width modulation. If one uses digital cameras, video cameras or smartphones to film or photograph the display, this can lead to undesired effects, especially a cropped image. Binary pulse width modulation already chops up the pulse width modulation compared to standard pulse width modulation. In the following, variants are described in which the binary pulse width modulation signal is further chopped up in order to reduce the problem described.

In the table in FIG. 8, the italic numbers in the time intervals of the first two rows indicate the significance of the respective bits. A 4-bit example is considered here, so that 3 stands for the most significant bit (MSB) and 0 for the least significant bit (LSB). The lines 23 indicate the programming times. The lines marked with reference 24 are additional programming times to improve scrambling.

In the example shown in FIG. 8, bit 3 is interrupted by bit 0 after half the execution time. Additional programming is necessary for this. If bit 3 is "high" and bit 0 is also "high", this does not result in a scrambling improvement. If bit 3 and 0 are different, an improvement is obtained. The described bit pattern can be used in all rows.

The programming frequency increases by ¼=25% in this 4-bit example. In an 8-bit example, only by ⅛.

The bit pattern described above, where bit 3 is interrupted by bit 0 after half the execution time, is applied to all rows.

To increase the probability of different bits, in the example shown in FIG. 9, bit 3 is interrupted after half the execution time of bit 0 and additionally bit 1. If one of the bits 0, 1 and 3 assumes a different state, the scrambling is improved. The programming effort is identical to that in FIG. 8.

To further improve scrambling, les significant bits are shifted into higher significant bits. In the example shown in FIG. 10, bit 1 is divided and shifted into bit 3. This allows bit 3 to be divided into thirds, resulting in even shorter pulses and improved scrambling. The programming effort here increases from 4 to 7 programmings per time interval and block.

LIST OF REFERENCE SIGNS

10 Curve
11 Arrow
12 Line
20 optoelectronic light emitting device
21 Display
22 Programming device
23 Line
24 Line

The invention claimed is:

1. An optoelectronic light emitting device, comprising:
a plurality of programmable pixels arranged in a matrix of rows and columns, each pixel comprising at least one optoelectronic semiconductor component, and
a programming device configured to program the pixels in a plurality of successive time intervals,
wherein a row pattern comprises a subset of the rows in the matrix,
wherein the programming device is configured to program the pixels in the subset of the rows included in the row pattern per time interval,
wherein the row pattern is shifted by at least one row per time interval,
wherein the programming device is configured to program the pixels of a row at most once per time interval,
wherein the programming device is configured to program bits of an image information in successive time intervals in a row according to a predetermined bit pattern, and
wherein in the bit pattern at least a part of at least one bit is inserted into another bit.

2. The optoelectronic light emitting device according to claim 1, wherein the row pattern is shifted by exactly one row per time interval.

3. The optoelectronic light emitting device according to claim 1, wherein the row pattern is shifted by more than one row per time interval.

4. The optoelectronic light emitting device according to claim 1, wherein in the bit pattern the bits are ordered according to their significance.

5. The optoelectronic light emitting device according to claim 1, wherein in the bit pattern the bits are not ordered according to their significance.

6. The optoelectronic light emitting device according to claim 1, wherein a pixel driver circuit is associated with each pixel.

7. A method for controlling an optoelectronic light emitting device comprising a plurality of programmable pixels arranged in a matrix of rows and columns, the method comprising:
programming the pixels in several, successive time intervals,
wherein each pixel comprises at least one optoelectronic semiconductor component,
wherein a row pattern comprises a subset of the rows in the matrix,
wherein the pixels in the subset of the rows included in the row pattern are programmed per time interval,
wherein the row pattern is shifted by at least one row per time interval,
wherein the pixels of a row are programmed at most once per time interval,
wherein bits of an image information are programmed in successive time intervals in a row according to a predetermined bit pattern, and
wherein in the bit pattern at least a part of at least one bit is inserted into another bit.

8. The method according to claim 7, wherein the row pattern is shifted by exactly one row or by more than one row per time interval.

9. The method according to claim 7, wherein in the bit pattern the bits are ordered according to their significance.

10. The method according to claim 7, wherein in the bit pattern the bits are not ordered according to their significance.

11. An optoelectronic light emitting device, comprising:
a plurality of programmable pixels arranged in a matrix of rows and columns, each pixel comprising at least one optoelectronic semiconductor component, and
a programming device configured to program the pixels in a plurality of successive time intervals,
wherein the programming device is configured to program n bits of an image information in successive time intervals in a row according to a predetermined bit pattern,
wherein the time intervals of the plurality of successive time intervals have a length equal to a length of a refresh cycle wherein all the rows in the matrix are rewritten with information divided by $2^n-1$, where n is a positive integer,
wherein a row pattern comprises a subset of the rows in the matrix,
wherein the programming device is configured to program the pixels in the subset of the rows included in the row pattern per time interval,
wherein the row pattern is shifted by at least one row per time interval,
wherein the programming device is configured to program the pixels of a row at most once per time interval.

12. The optoelectronic light emitting device according to claim 11, wherein in the bit pattern at least a part of at least one bit is inserted into another bit.

13. The optoelectronic light emitting device according to claim 11, wherein the row pattern is shifted by exactly one row per time interval.

14. The optoelectronic light emitting device according to claim 11, the row pattern is shifted by more than one row per time interval.

15. The optoelectronic light emitting device according to claim 11, wherein in the bit pattern the bits are ordered according to their significance.

16. The optoelectronic light emitting device according to claim 11, wherein in the bit pattern the bits are not ordered according to their significance.

17. The optoelectronic light emitting device according to claim 11, wherein the programming device is configured cause a first bit pattern to be interrupted by a second bit by dividing the second bit into a first quantity of parts of the second bit and shifting the first quantity of parts of the second bit into the first bit with the first bit being divided into a second quantity of parts of the first bit greater than the first quantity of parts of the second bit.

* * * * *